US011982056B2

(12) United States Patent
Lichtberger

(10) Patent No.: US 11,982,056 B2
(45) Date of Patent: May 14, 2024

(54) METHOD FOR AUTOMATIC CORRECTION OF THE POSITION OF A TRACK

(71) Applicant: HP3 Real GmbH, Vienna (AT)

(72) Inventor: Bernhard Lichtberger, Vienna (AT)

(73) Assignee: HP3 Real GmbH, Vienna (AT)

( * ) Notice: Subject to any disclaimer, the term of this patent is extended or adjusted under 35 U.S.C. 154(b) by 740 days.

(21) Appl. No.: 17/268,519

(22) PCT Filed: Aug. 12, 2019

(86) PCT No.: PCT/AT2019/060256
§ 371 (c)(1),
(2) Date: Feb. 15, 2021

(87) PCT Pub. No.: WO2020/037343
PCT Pub. Date: Feb. 27, 2020

(65) Prior Publication Data

US 2021/0222373 A1 Jul. 22, 2021

(30) Foreign Application Priority Data

Aug. 20, 2018 (AT) ..... A 50701/2018

(51) Int. Cl.
*E01B 27/17* (2006.01)
*E01B 29/04* (2006.01)
*E01B 35/00* (2006.01)

(52) U.S. Cl.
CPC ..... *E01B 27/17* (2013.01); *E01B 29/04* (2013.01); *E01B 35/00* (2013.01)

(58) Field of Classification Search
CPC ..... E01B 27/17; E01B 29/04; E01B 35/00
See application file for complete search history.

(56) References Cited

U.S. PATENT DOCUMENTS 3,875,865 A * 4/1975 Plasser ..... E01B 35/00 104/8
5,012,413 A * 4/1991 Sroka ..... E01B 35/02 701/19

(Continued)

FOREIGN PATENT DOCUMENTS

EP 0930398 A1 7/1997
EP 1028193 A1 8/2000

(Continued)

OTHER PUBLICATIONS

B. Lichtberger, Handbuch Gleis, DW Media Group GmbH/ Eurailpress, 2010, pp. 472-473.

*Primary Examiner* — Scott A Browne
(74) *Attorney, Agent, or Firm* — Tiajoloff & Kelly LLP

(57) ABSTRACT

The invention relates to a method for the automatic correction of the position of individual faults (H(n)) of a track formed by rails (16) and sleepers (9) with a track tamping machine (2). After the left and right rails have been surveyed independently by means of an inertial measuring unit (11), the length and position of the individual fault (TAMP, S, E) to be corrected is determined by taking into account a limit value of the individual faults ($F_{LIM}$) and a maximum extension ($s_{max}$) in the longitudinal direction of the track (s). The tamping units (7) of the tamping machine (s) are positioned exactly at the starting point (S) and end the tamping at the end point (E) of the determined track correction section (TAMP). Both track sections ($F_{LP}$,$F_{RE}$) are tamped and corrected simultaneously.

9 Claims, 4 Drawing Sheets

(56) References Cited

U.S. PATENT DOCUMENTS

Figure 1:
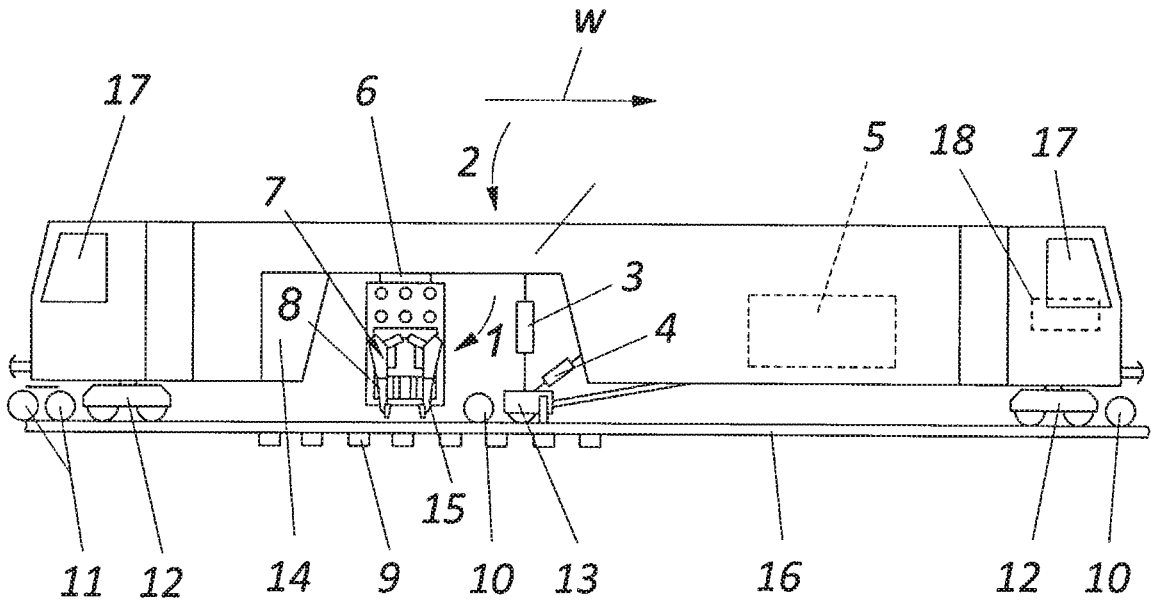

| | | | | |
|---|---|---|---|---|
| 6,260,485 | B1 | 1/2001 | Theurer et al. | |
| 6,220,170 | B1 | 4/2001 | Theurer et al. | |
| 7,181,851 | B2 * | 2/2007 | Theurer | E01B 35/00 104/2 |
| 9,631,325 | B2 * | 4/2017 | Lichtberger | E01B 27/17 |
| 11,174,598 | B2 * | 11/2021 | Auer | E01B 27/17 |
| 2019/0316300 | A1 | 10/2019 | Auer | |

FOREIGN PATENT DOCUMENTS

| | | | |
|---|---|---|---|
| EP | 3358079 | A1 | 8/2018 |
| WO | 2018082798 | A1 | 5/2018 |

* cited by examiner

METHOD FOR AUTOMATIC CORRECTION OF THE POSITION OF A TRACK

FIELD OF THE INVENTION

The invention relates to a method for correcting individual faults of a railroad track formed by rails and sleepers.

DESCRIPTION OF THE PRIOR ART

A method for correcting the position of individual faults is known from EP1 028 193 B1. In "Handbuch Gleis"; Dr. Bernhard Lichtberger, DVV Media Group GmbH/Eurailpress (ISBN 978-3-7771-0400-3), as published in 3rd edition from 2010, an individual fault correction machine is described on page 472 with the "UNIMAT Sprinter".

Tamping units of track tamping machines penetrate the ballast of a track bed with tamping tools in the area between two sleepers (intermediate compartment) in the area of the support of the sleeper in the ballast under the rail and compact the ballast by a dynamic vibration of the tamping tines between the opposing tamping tines which can be adjusted to each other. The more uniformly a track is compacted from sleeper to sleeper, the more durable is the achieved geometric track position after maintenance work. When ballast is used for a long time (long lay times typically more than 10 years), the ballast is usually heavily contaminated and worn. First, the ballast grains break off at the grain tips, and the broken-off pieces then lie between the ballast grains. Rock dust collects in between (abrasion of the ballast grains under traffic load). This results in different ballast conditions and stiffnesses from sleeper to sleeper. Under the wheel loads, different depressions occur under the sleeper depending on the stiffness of the ballast. The wheels react to this with fluctuations in wheel force, which on the one hand negatively influence the running behavior of the trains and on the other hand place high stresses on the track and the vehicles. This increases the wear of the wheels and the running gear. It also leads to a rapid deterioration in the quality of the track.

Results from practice show that approx. one individual fault per km of track can be expected on the operated railroad lines. These show no correlation to the track geometry. They occur with about the same frequency in straight lines, in curves or in transition curves. The position corrections carried out according to the procedure described in EP1 028 193 B1 and with the individual fault correction machine "UNMAT Sprinter" show that between 50-60% of the individual faults corrected in this way could not be durably eliminated and return to their previous size after a short period of operation. Since there is no obvious connection with track geometry elements, the cause of the recurring individual faults must be sought in the ballast properties or the subgrade. With the current methods according to the known prior art, no indication can be given in the sense of an objective proof of quality, as well as with regard to the durability of the corrected individual fault or the condition of the ballast after the elimination of an individual fault.

Often the trigger of an individual fault is a singular track discontinuity such as an uneven rail joint or a hollow sleeper. Trains running over this unevenness exert high dynamic forces. As a result, the ballast under these areas is subjected to high stress, breaks at the edges, rounds off, and the fractions of fines fill the voids between the ballast grains. The fault not only becomes larger, but also expands longitudinally because of the wheel-rail interaction. Due to the excited car bodies (deflection and rebound stimulated by the track fault), subsequent individual faults occur with typically smaller and decreasing fault height.

The individual fault correction method known from EP1 028 193 B1 has the following shortcomings:

Electronic smoothing is performed, which means that the actual fault lying in the track is only approximated.

The left and right rails are only tamped underneath on the respective fault length of the individual rail side. If these faults are clearly offset from each other in the longitudinal direction, a twisting fault is installed. The method starts with the position correction by under-tamping the track at the respective determined starting point (at the high point) without lifting. It is known from investigations that already with tamping without lifting, a settlement of 5 mm occurs under the tensile loads. According to the method described in EP1 028 193 B1, this results in up to four successive twisting faults (calculated with the usual twisting base of 3 m) of up to 5 mm each. The intervention threshold requiring track correction is close to this value. The track geometry left behind would therefore already be borderline in terms of twisting.

The beginning and end of tamping is placed exactly on the high point. The high point of the track is formed by particularly tightly resting sleepers. If these remain in their extremely firm support, then after tamping an abrupt transition between hard (before the track fault) and soft (along the length of the track fault) remains. This maintains the high dynamic wheel-rail interaction. The corrected fault will recur quickly.

Another disadvantage of the method according to EP1 028 193 B1 is that no check of the determined nominal geometry with regard to the expected twisting errors is carried out before the actual work and a correction of the design is possibly carried out.

Another disadvantage is that the use of multiple tamping or the choice of tamping parameters is left to the machine operator and he can proceed as he sees fit. The current state of the ballast is not recorded and is not included in the planning of the design of the track geometry.

According to EP1 028 193 B1, only the track geometry left behind is recorded as a check on the quality of the work performed. This does not provide any information about the durability of the track correction and also no information about the ballast conditions in the fault area.

It is known to provide guidance computers for tamping machines with which track geometries can be recorded and stored. With inertial systems or north-based navigation systems, the directional errors and the track superelevation can be recorded in addition to the elevation errors.

There are also tamping units with fully hydraulic tamping drives that measure the ballast bed hardness by measuring the compaction force and the compaction distance. These provide information about the contamination of the ballast and the ballast condition by recording the ballast hardness and the achieved compaction (compaction force) of the ballast by tamping. If, for example, only a low compaction force is measured during tamping (typically 10-30 kN compaction force, ballast bed hardness<150 Nm) then the ballast is crushed and rounded there. Sufficient interlocking of the ballast grains cannot be achieved. The tamping will not have any durability. The corrected individual fault will form again shortly (typically within 1-2 million Lto). Depending on the level of the fault, multiple tamping will be used according to the prior art. For a track elevation of more than 40 mm, for example, tamping twice or, from 60 mm, tamping three times at the same sleeper is applied.

A method for correcting vertical positional errors of a track by means of a track tamping machine and a dynamic track stabilizer is known from WO2018082798 (A1), in which, on the basis of a detected actual track position, an overlift value is specified for a processed track point, with which the track is raised and tamped into a preliminary overlift track position and subsequently lowered into a resulting final track position by means of dynamic stabilization. A smoothed actual track position is formed from a course of the actual track position, and an overlift value is specified for the processed track point as a function of the course of the actual track position with respect to the smoothed actual track position course. A further method for correcting the position of a track consisting of track sections arranged next to one another and branch tracks connecting them is known from EP 0 930 398 (A1), wherein the track position correction is carried out with synchronous raising and/or lateral displacement on the basis of track correction values determined from the nominal and actual position.

SUMMARY OF THE INVENTION

The invention is therefore based on the object of providing a method for correcting the track position of extreme individual longitudinal height faults which substantially increases the durability of the track position of the corrected individual faults compared to the methods known to date, and which offers the possibility of predicting the durability by objective measurement.

According to the invention, this object is solved with a method characterized by the following steps:

Surveying the amplitude- and phase-true non-distorted elevation progression of the left and right rails, the directional error and the superelevation using an inertial measurement system or a north-based navigation measurement system.

Determining the height error length of the left and right rail to be corrected.

Determining the reference elevation line for the left and right rails with calculation of the elevations to be performed for the left and right rails.

Selecting the starting point N sleepers (typically 6) before the high point before the individual fault and selection of the end point M sleepers (typically 6) after the high point after the individual fault.

Checking compliance with permissible torsion of the determined and planned target geometry of both elevations.

Positioning of the tamping unit exactly at the determined starting point and termination of tamping exactly at the determined end point.

Carrying out track position correction with simultaneous independent control and correction of the heights of the left and right rail tracks.

According to the invention, the method can be extended by trial tamping to determine the ballast hardness with the tamping unit. For this purpose, e.g. after measuring the track geometry in the now known fault area, a test tamping without lifting is carried out to determine the ballast bed hardness and the compaction force and thus the ballast condition. Depending on the condition of the ballast, the track can then be overlifted to achieve better durability.

According to the invention, after this trial determination of the ballast condition in the area of the individual fault, the worn ballast can be removed and replaced by new ballast with machines carried along, if necessary, in order to be able to rule out a recurrence of the track fault.

According to the invention, the ballast condition (ballast hardness, compaction force) is measured and recorded at each sleeper during track position correction. These values can be used to make a prediction about the durability of the track geometry in the area of the individual fault that has been corrected. This measurement data can then be used to plan the ballast replacement under sleepers with worn ballast, so that when the new individual fault is corrected in the expected short time, this can be done permanently.

According to the invention, in addition to the dominant longitudinal height errors, the directional error and the superelevation are corrected at the same time. The directional error is derived analogously from the IMU measurements and the resulting correction values are specified to the machine control system. The superelevation is included in the calculation of the reference heights of the two rails.

The main advantages of the method according to the invention are the precise phase- and amplitude-true detection of the individual faults, a leveling out of the vertical stiffness, an extension of the durability of the track geometry of the corrected individual fault and a quality verification by means of the ballast hardness and the compaction force for the individual sleepers to be processed and, based on this, well-founded statements about the expected durability of the track fault correction. A low ballast hardness (W . . . soft, N . . . normal, H . . . hard) is an indication of destroyed ballast and greatly reduced durability of the tamping.

BRIEF DESCRIPTION OF THE INVENTION

Figure 4:
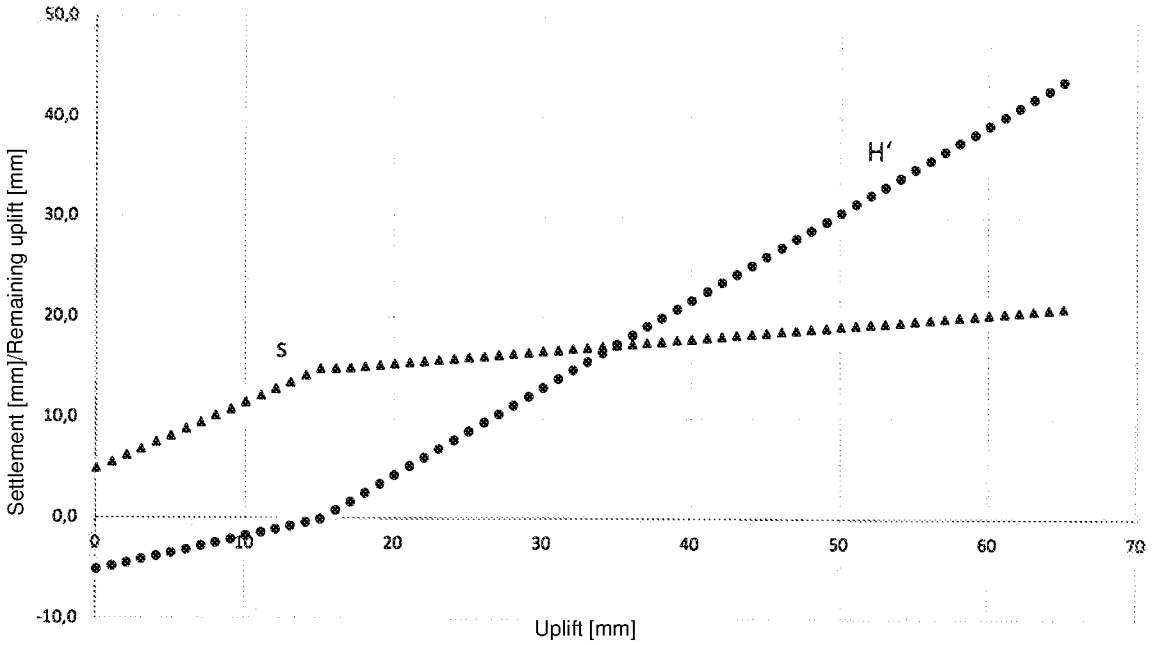
Figure 2:
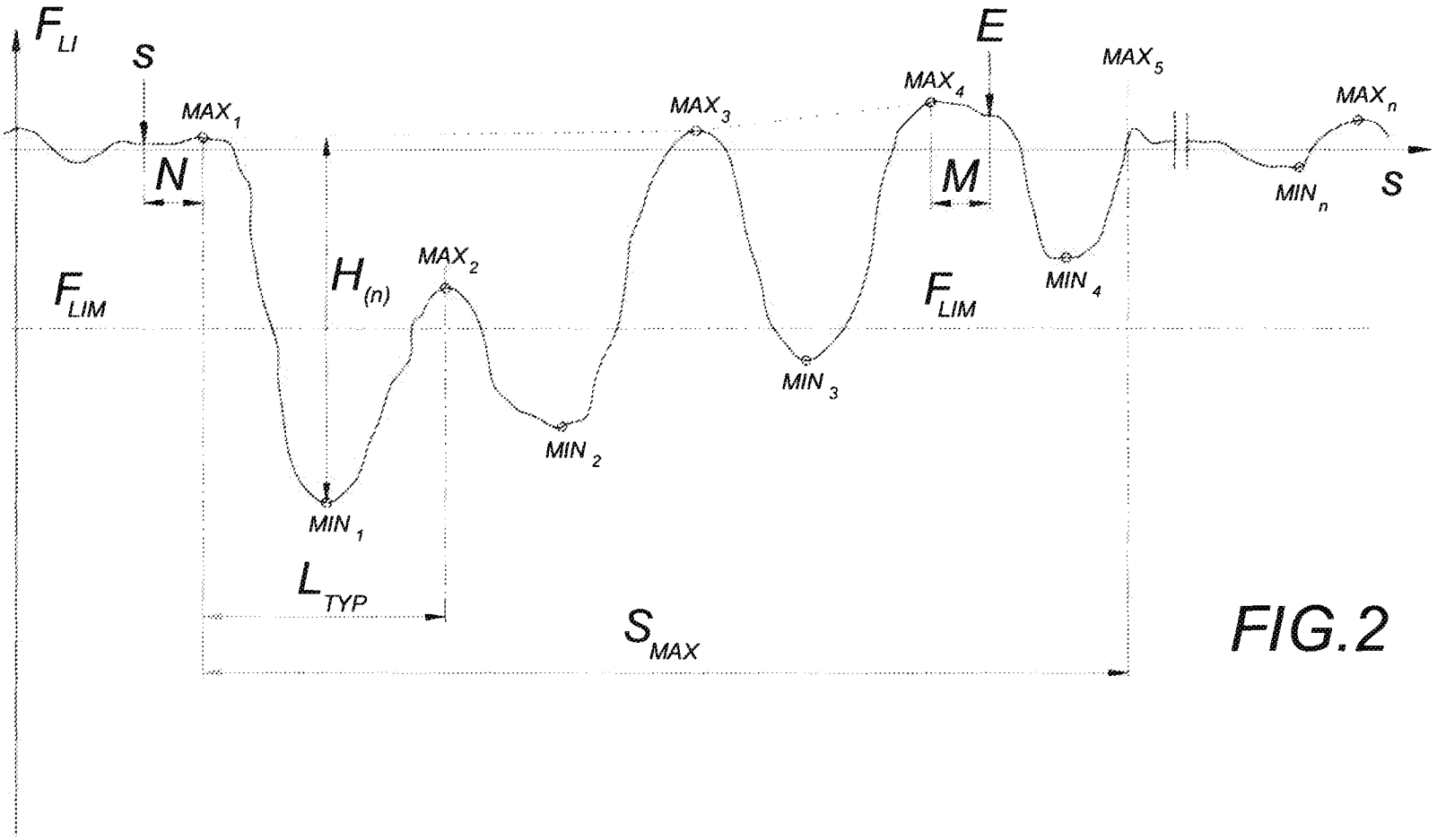
Figure 3:
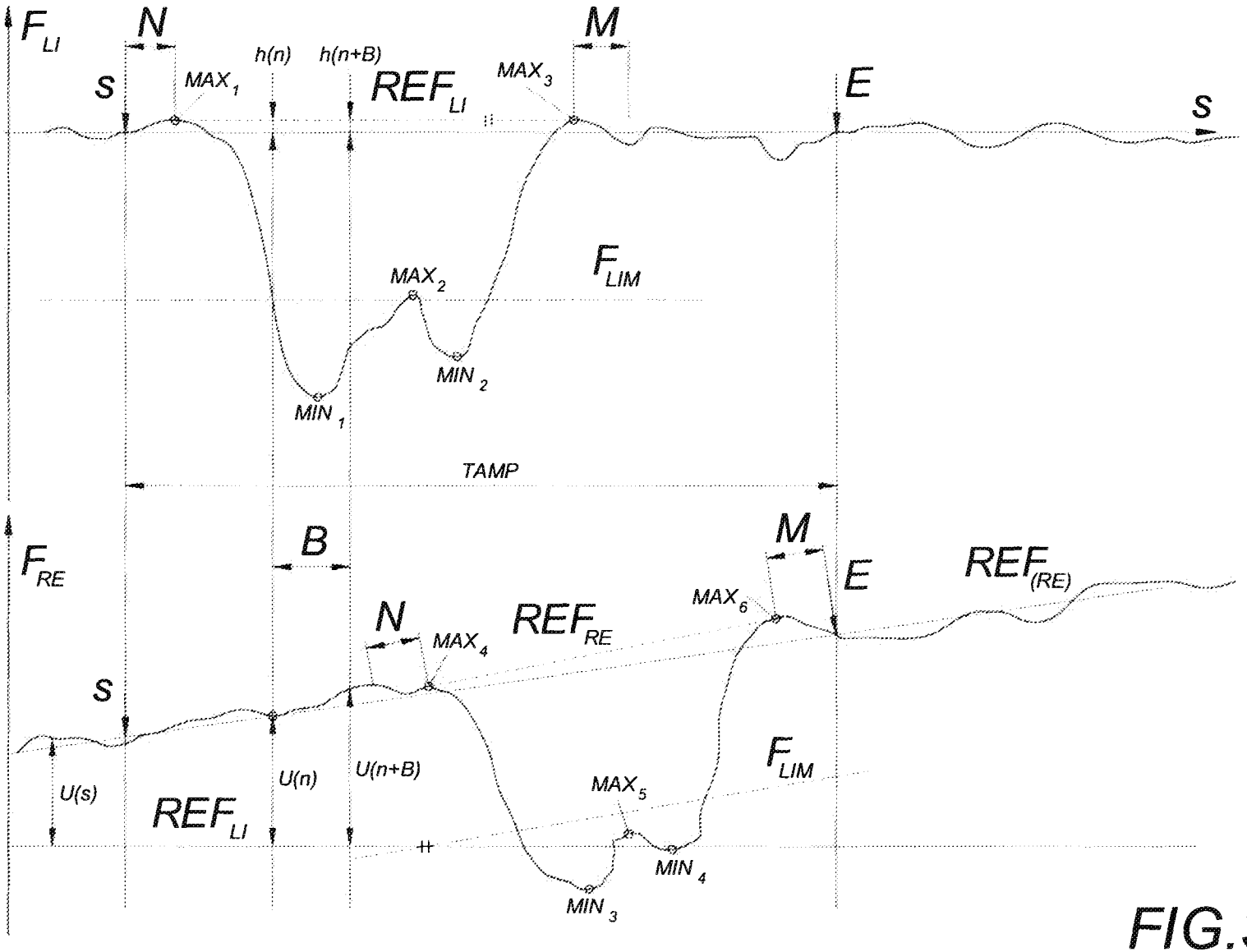
Figure 5:
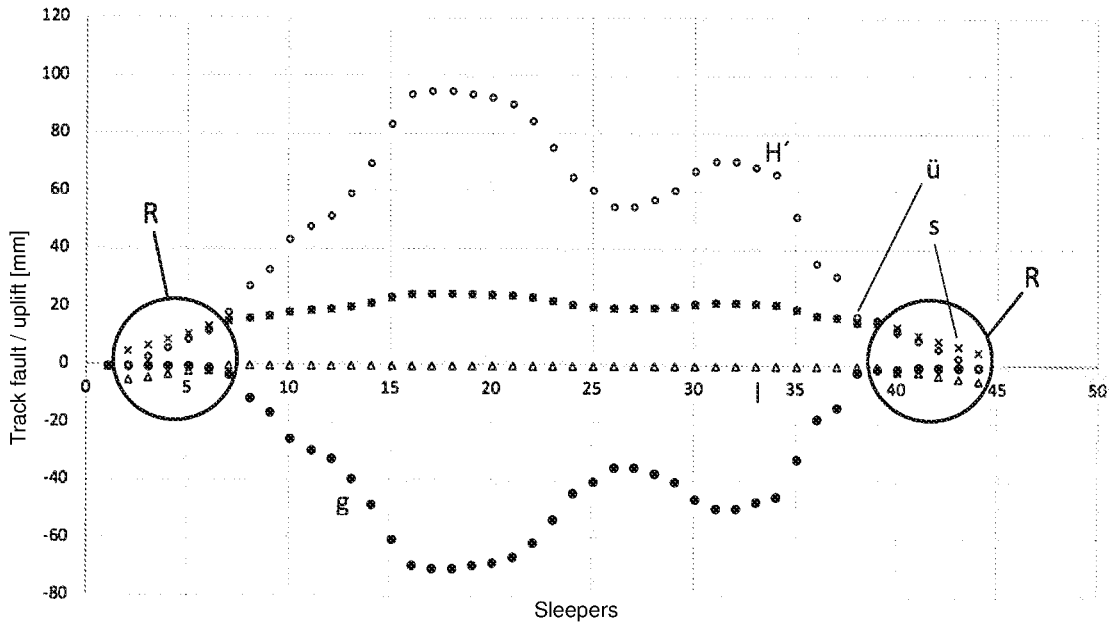
Figure 6:
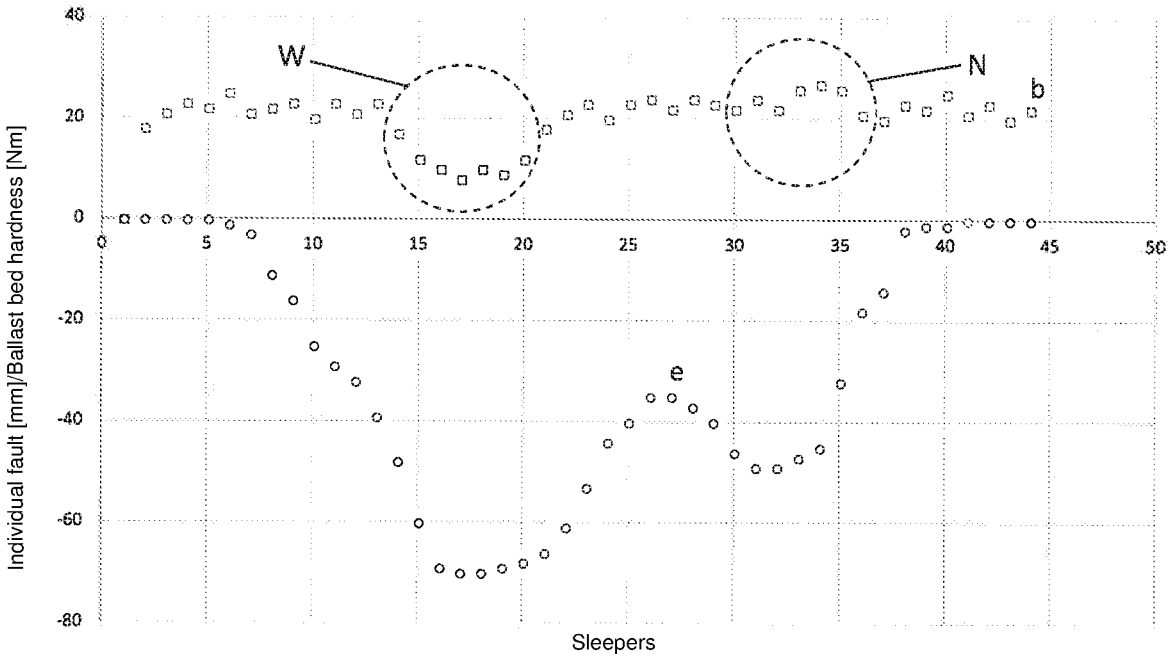

The drawings describe the method according to the invention, wherein:

FIG. 1 schematically shows an individual fault tamping machine;

FIG. 2 schematically shows a measured individual fault of a rail line;

FIG. 3 schematically shows a representation of the measured individual fault curves of the left and right rail;

FIG. 4 shows a diagram showing the course of the settlement depending on the elevation, as well as the course of the remaining elevation in the track;

FIG. 5 schematically shows an individual fault, the course of an overlift of the track and the resulting track position after stabilization of the track (after complete settlement);

FIG. 6 schematically shows an individual fault and the course of the ballast bed hardness over the length of the individual fault.

DESCRIPTION OF THE PREFERRED EMBODIMENTS

FIG. 1 shows an individual fault tamping machine 2. The working direction is indicated by W. A lifting and lining device 13 is used to lift and straighten the track to the target position by means of lifting drives 3 and lining drives 4. The track position is corrected by the tamping unit 7 and the tamping tools 8, 15 which plunge into the ballast and compact the ballast under the sleepers 9. The machine 2 is powered by a drive motor 5 during work and travel. The machine 2 is designed in such a way that it can also correct individual faults in switches. For this purpose, the machine is equipped with pivotable tamping tines 8, 15, split-head tamping units 7 and a rotating device 6 for the tamping units 7. The machine 2 can be moved along the track 16 by means of bogies 12. The rails 16 rest on the transverse sleepers 9 which lie in the ballast bed. The machine control and regulating system consists of the two measuring carriages 10 and the rear IMU measuring carriage 11. The machine control and measuring system is usually designed as a cord measuring system. In this case, one cord runs centrally for the lining position and two other cords are run over the rails 16 for the longitudinal height position. The sensors for recording the longitudinal heights and the direction are located on the center measuring carriage 10. The rear measuring carriage 11 is designed in such a way that an inertial unit or north-based navigation system mounted on it can record the longitudinal height of both rails, the directional position and the transverse height as a function of the path. An odometer is used to record the displacement s during the measurement run. The measured values are recorded, displayed and stored equidistantly on an on-board computer with display 18. The vehicle has two cabs 17.

FIG. 2 shows an example of an individual fault curve $F_{Li}$ of the left rail along the curve length s of the track. $F_{Lim}$ indicates a limit below which a fault must fall in order to be treated as an individual fault to be corrected. A simple mathematical way to determine the size of the individual faults and the high points is to find the maxima (MAX) and minima (MIN). The typical length of a pronounced individual fault $L_{Typ}$ is between 12-15 m. If there are other individual faults in the neighborhood of the first detected fault that fall below the $F_{Lim}$ limit ($MIN_1$, $MIN_2$, $MIN_3$), then these are only considered if they are within a maximum length $s_{max}$ (e.g. typically 35-40 m). This is to avoid that instead of correcting the dangerous individual faults, entire sections of the line are worked through. According to the invention, the aim is the automatic computer-aided determination of the defective tamping area and the tamping parameters. Mechanized correction of individual faults is only carried out in the case of dangerous individual faults which, if not corrected, would lead to a track blockage or a slow speed section. Since these should be corrected as quickly as possible, working through longer sections would be inefficient. $F_{Lim}$ is set in such a way that individual faults that are almost of the same magnitude as the actual triggering individual fault are also corrected. This is efficient because otherwise these faults would develop into a critical fault in the near future. H(n) indicates the lifting value at sleeper n. The dashed line connecting the maxima ($MAX_1$, $MAX_2$, $MAX_3$) is the reference height line of the left rail to which the rail is brought by the correction. In order to achieve a uniform vertical stiffness profile in the longitudinal direction (softening the hard high point regions), tamping is started N sleepers (typically 6) before the high point $MAX_1$ and ended M sleepers (typically 6) after the last high point $MAX_3$. Since the track fault with the minimum $MIN_4$ is above the fault limit $F_{Lim}$ (i.e. smaller) it is not considered for correction and remains uncorrected in the track. S marks the starting point of the tamping and E the end. The machine operator can determine the exact positioning at the starting point S using the graphic display on the master computer 18.

FIG. 3 shows an example of the individual fault curve $F_{Li}$ of the left rail at the top and the individual fault curve $F_{Re}$ of the right rail at the bottom. The right rail shows an increasing superelevation u(x) as a general case. The individual fault is therefore in a transition arc. As described before, the individual faults with respect to start and end point are first treated separately for both rails. For the left rail, the reference line $REF_{Li}$ is obtained and for the right superelevated rail the reference line $REF_{Re}$, which rises according to the superelevation ramp u(s). Since a settlement of 5 mm occurs after tamping even without lifting, the individual faults on the left and right are lifted separately in height, but both sides are always tamped under at the same time. The settlement then occurs equally on both sides of the rail, so that there is no twisting error. The first longitudinal height error detected in the longitudinal direction and to be corrected is taken as the starting point S, and the last longitudinal height error detected and to be corrected is taken as the end point E. In order to check whether any impermissible twisting errors occur, the difference of the superelevations is calculated over the typical base length B of the twist of 3 m.

The twist V is calculated as: V=[u(n)+h(n)]−[u(n+B)+h(n+B)] where n is the sleeper under consideration. The twist is calculated for all positions starting at the starting point (or B=3 m before) to the end point (or B=3 m after) and compliance with the acceptance threshold for the twist is checked. If this is not complied with, then the reference elevation lines must be modified accordingly. This is necessary, as shown in the next figures, especially if the track is superelevated for reasons of higher durability of the track position, so that it adapts to the optimum straight reference line after the expected settlement during the stabilization phase of the track.

FIG. 4 shows schematically the settlement S (line marked with triangles) depending on the previously performed uplift H'. From this, the curve of the remaining uplift v in the track (permanent correction) can be indicated (line with dots). Such progressions are given in various publications. One of them can be found in "Handbuch Gleis" Author: Dr. Bernhard Lichtberger, DVV Media Group GmbH/Eurailpress (ISBN 978-3-7771-0400-3), 3rd edition from 2010 in FIG. 287 on page 463.

The settlement S can be simplified depending on the uplift H as follows:

$$\text{for } H \leq 15 \text{ mm } S = \frac{2}{3} \cdot H + 5$$

$$\text{for } H > 15 \text{ mm } S = \frac{1}{8} \cdot H + 13$$

For the remaining uplift H' depending on the track fault F, the following applies:

$$F \leq 15 \text{ mm } H' = (F + 5) \cdot 3$$

$$F > 15 \text{ mm } H' = \frac{8}{7} \cdot F + 15$$

As can be seen from the formulas and the diagram, the track settles by S=5 mm at zero H=0 uplift. The reason for this is that the tamping tools 8, 15 take up space and displace part of the ballast just by dipping the tines into the ballast. This corresponds to a loosening of the ballast in the area of the sleepers, which then begin to settle under the live load.

FIG. 5 shows the curve of an individual fault g (line with dots) as an example. In order to make the track position more durable, or to take into account the expected settlement, the above formula $$H' = \frac{8}{7} \cdot F + 15$$

is used to calculate the necessary uplift H' (line with circles). The reference line for the height of the rail is now not a straight line running between the maxima but a curved line (line with diamonds). Under the tensile load, the track settles and assumes the reference height line (line with triangles) after complete stabilization. At the initial and final areas R, the lifting value H' is built up via a ramp (length typically e.g. 3 m). Since the lifting values are initially zero or very small, the track settles below the zero reference line. This corresponds to a small residual longitudinal height error at the beginning and at the end which cannot be avoided, but can be neglected in practice. The overlift ü, the settlement s and the track position I after stabilization are shown.

FIG. 6 shows as an example the curve of the individual fault e from the previous diagram (line with circles). The diagram shows the ballast bed hardness b determined by the fully hydraulic tamping unit during tamping. The ballast bed hardness in the marked area W is low. The cause is crushed rounded ballast that can no longer be sufficiently compacted (interlocked). If ballast is not replaced prior to reworking, this area should definitely be overlifted to ensure longer durability of the track. In the area N of the track fault, on the other hand, good normal ballast hardnesses are present. Durable tamping can be expected here. With the aid of the ballast hardnesses determined during tamping, the expected durability of the individual fault correction can thus be specified. In the example shown, the infrastructure manager should replace the ballast in the marked area of sleeper W with new serviceable ballast. After the measurement run, the ballast hardness or the achievable compaction force can be measured by test tamping (at least one in the areas of greatest uplifts, i.e. in the example at sleeper 17 and at sleeper 32). For this purpose, the test sleeper is tamped without uplift and the ballast bed hardness and the compaction force as well as the adjusting distance (moving distance of the tamping tines 8, 15) are determined. On the basis of the known conditions, the track can be overlifted. If a machine is on site with which ballast can be replaced in advance, this is carried out before tamping. After the ballast has been exchanged, a new measurement run must be carried out to plan the individual fault correction. After the work through, the track position can be artificially stabilized (settlement) by means of a dynamic track stabilizer. Stabilization with the dynamic track stabilizer reduces and smooths out some of the overlifted values caused by the track stabilizer. These settlements would take place without the use of the track stabilizer by the loading trains (the track stabilizer effect corresponds to approx. 150,000 Lto of equivalent train traffic).

DESIGNATIONS USED

1 Tamping unit
2 Tamping machine
3 Lifting cylinder
4 Lining cylinder
5 Diesel engine
6 Rotating device of tamping unit
7 Tamping tool
8 Tamping tine
9 Sleeper
10 Center measuring carriage
11 IMU measuring carriage
12 Bogie
13 Lifting and lining unit
14 Work cabin
15 Tamping tine
16 Rail
17 Driver's cabin
18 Master computer
W Soft ballast bed, working direction of the machine
N Normal ballast bed
R Start and end ramp
B Base length of twist
S Starting point
E End point
MIN Minima in the height position
MAX Maxima in the height position
s Arc length
M Re-tamping length
N Pre-tamping length
H(n) Lifts
u(n) Superelevation
$F_{lim}$ Critical error limit value
TAMP Tamping area
REF Reference line for lifting
$S_{max}$ Limit range of maximum individual fault length

The invention claimed is:

1. A method for automatically correcting the position of a track formed by left and right rails and sleepers with a track tamping machine, said method comprising the following steps:

surveying the left and right rails of a track section independently of each other so as to determine and record an actual height position of each rail, a track direction, and a track superelevation using an inertial measuring unit and a computing and control unit;

determining a starting point and an end point of an individual fault of the left rail and of the right rail to be corrected based at least in part on a limit value of the individual fault and a maximum extension in a longitudinal direction of the track;

selecting the starting point depending on progression of the individual fault of the rail that is closer to the track tamping machine and selecting the end point depending on progression of the individual fault of the rail that is farthest in the longitudinal direction from the track tamping machine;

defining a height reference line for the left rail and a height reference line for the right rail based at least in part on the track superelevation;

positioning tamping units of the tamping machine and starting tamping exactly at the starting point of the individual fault of the determined track correction section, wherein sections of both left and right rails are corrected simultaneously and, in addition to the individual fault, the track direction is also corrected, and wherein the tamping is terminated at the end point.

2. The method according to claim 1, wherein the method further comprises after the surveying, test tamping in a region of maximum faults occurring so as to determine ballast bed hardness and, on the basis of the ballast bed hardness, the track is overlifted so as to improve the durability of the track position correction by using an expected settlement in the track position correction.

3. The method according to claim 2, wherein depending on the ballast bed hardness determined by the test tamping and the lifting correction height, the track is controlled by the tamping machine in operating modes of single tamping, multiple tamping, automatic optimized tamping or high-pressure tamping.

4. The method according to claim 2, wherein, depending on the ballast bed hardness determined by the test tamping, worn and worn-out ballast is replaced using a ballast replacement machine and then a new surveying step is carried out with subsequent individual fault correction.

5. The method according to claim 1, wherein the starting point of the tamping is located at a range before an actual start of the individual fault and the end point is located at a range after an actual end of the individual fault.

6. The method according to claim 1, wherein lifting is built up away from the starting point via a ramp and is reduced towards the end via a ramp.

7. The method according to claim 1, wherein immediately after the individual fault correction the track is processed with a dynamic track stabilizer.

8. The method according to claim 1, wherein ballast bed hardness is determined at each tamping at each sleeper and is recorded and stored as proof of quality and used to predict durability of the individual fault correction.

9. The method according to claim 1, wherein a respective position of the tamping unit relative to the track is displayed on a monitor.

* * * * *